US009328725B2

(12) United States Patent
Chou

(10) Patent No.: US 9,328,725 B2
(45) **Date of Patent: *May 3, 2016**

(54) AIR COMPRESSOR HAVING BUFFERING COMPARTMENT

(71) Applicant: Wen San Chou, Tainan (TW)

(72) Inventor: Wen San Chou, Tainan (TW)

( * ) Notice: Subject to any disclaimer, the term of this patent is extended or adjusted under 35 U.S.C. 154(b) by 367 days.

This patent is subject to a terminal disclaimer.

(21) Appl. No.: 13/847,537

(22) Filed: Mar. 20, 2013

(65) Prior Publication Data

US 2014/0286799 A1 Sep. 25, 2014

(51) Int. Cl.

| | |
|---|---|
| ***F04B 49/00*** | (2006.01) |
| ***F04B 39/12*** | (2006.01) |
| ***F04B 49/10*** | (2006.01) |
| ***F04B 49/24*** | (2006.01) |

(52) U.S. Cl.

CPC ..... *F04B 39/123* (2013.01); *F04B 49/10* (2013.01); *F04B 49/24* (2013.01)

(58) Field of Classification Search

CPC .... F04B 39/0027; F04B 39/123; F04B 49/10; F04B 49/24

USPC ..... 417/274, 540, 543

See application file for complete search history.

(56) References Cited

U.S. PATENT DOCUMENTS

| | | | | | |
|---|---|---|---|---|---|
| 302,978 | A * | 8/1884 | Brislin | ..... | 417/571 |
| 2,761,615 | A * | 9/1956 | Prince | ..... | 92/60.5 |
| 3,415,441 | A * | 12/1968 | Kehler | ..... | 417/440 |
| 4,373,870 | A * | 2/1983 | Pandzik | ..... | 417/269 |
| 6,213,725 | B1 | 4/2001 | Chou | | |
| 6,514,058 | B1 | 2/2003 | Chou | | |
| 6,655,928 | B2 | 12/2003 | Chou | | |
| 6,783,333 | B2 * | 8/2004 | Wang | ..... | 417/307 |
| 6,846,162 | B2 | 1/2005 | Chou | | |
| 6,945,062 | B2 * | 9/2005 | Chen et al. | ..... | 62/228.5 |
| 7,240,642 | B2 | 7/2007 | Chou | | |
| 7,462,018 | B2 | 12/2008 | Chou | | |
| 2002/0141890 | A1 * | 10/2002 | Chou | ..... | 417/415 |
| 2007/0065311 | A1 * | 3/2007 | Chou | ..... | 417/415 |

* cited by examiner

*Primary Examiner* — Charles Freay
(74) *Attorney, Agent, or Firm* — Charles E. Baxley

(57) ABSTRACT

An air compressor assembly includes a cylinder housing, an outlet receptacle disposed on the cylinder housing, and a partition having an air passage formed between the cylinder housing and the outlet receptacle, and a piston slidably received in the cylinder housing for generating a pressurized air, the partition includes a channel communicating with the chamber of the cylinder housing, and the cylinder housing includes a compartment formed in a casing and communicating with the channel of the partition for partially receiving the pressurized air and for buffering purposes. An adjustable plug is engaged in the casing for adjusting the volume of the compartment of the casing.

6 Claims, 7 Drawing Sheets

AIR COMPRESSOR HAVING BUFFERING COMPARTMENT

BACKGROUND OF THE INVENTION

1. Field of the Invention

The present invention relates to an air compressor assembly, and more particularly to an air compressor assembly including a cylinder housing having a compressing chamber for slidably receiving or engaging with a piston and having a buffering compartment formed in the cylinder housing and communicating with the compressing chamber of the cylinder housing for partially receiving the pressurized air or for receiving a portion of the pressurized air and for buffering purposes and for allowing the piston head to effectively compress or pump the air in the pumping movement or stroke and/or for suitably increasing the compressing or pumping or pressurizing effect or operation to the air.

2. Description of the Prior Art

Typical air compressors comprise a cylinder housing attached or secured to a base and having a piston slidably disposed in a compressing chamber thereof, and a motor secured to the base and coupled to the piston of the cylinder housing for actuating or driving the piston of the cylinder housing in a reciprocating action, in order to generate a pressurized air of a greater air pressure and a decreased flowing quantity and for supplying the pressurized air to inflate various air facilities, such as tires, air beds, air cushions, hovercrafts, etc.

The cylinder housing normally includes an outlet receptacle having a compartment formed therein and having one or more outlet ports communicating with the compartment of the outlet receptacle for selectively or changeably attaching and securing or coupling various parts or elements or attachments or facilities, such as the pressure gauges, the air nozzles, the relief valves, the safety valves or the like.

The applicant has developed various kinds of typical air compressors, including at least U.S. Pat. No. 6,213,725 to Chou, U.S. Pat. No. 6,514,058 to Chou, U.S. Pat. No. 6,655,928 to Chou, U.S. Pat. No. 6,846,162 to Chou, U.S. Pat. No. 7,240,642 to Chou, and U.S. Pat. No. 7,462,018 to Chou each of which also comprise a piston slidably disposed within a compressing chamber of a cylinder housing, a spring valve having one end secured to the piston and having the other end for selectively blocking an air aperture of the piston, in order to control the air to flow through the piston, and a motor secured to the base and coupled to the piston of the cylinder housing for actuating the piston of the cylinder housing to move in the reciprocating action relative to the cylinder housing, and an outlet receptacle extended or formed on top of the cylinder housing and having a compartment formed therein for receiving the pressurized air from the cylinder housing and having one or more outlet ports communicating with the compartment of the outlet receptacle for selectively or changeably attaching and securing or coupling various parts or elements or attachments or facilities, such as the pressure gauges, the air nozzles, the relief valves, the safety valves or the like.

The piston head of the piston normally includes a solid structure having a planar forcing or actuating surface for forcing or pushing or compressing or pumping the air in the pumping movement or stroke in order to generate the pressurized air.

However, the compressing chamber of the cylinder housing includes a solid structure having no other space or cavity or chamber or compartment formed in the cylinder housing for partially receiving the pressurized air such that the piston may not be effectively moved relative to the cylinder housing and may not be effectively operated to compress or pump the air in the pumping movement or stroke and such that the piston may have a good chance to generate a pressurized air having an over-pressurized condition.

The present invention has arisen to mitigate and/or obviate the afore-described disadvantages of the conventional structures for the air compressors.

SUMMARY OF THE INVENTION

The primary objective of the present invention is to provide an air compressor assembly including a cylinder housing having a compressing chamber for slidably engaging with a piston and having a buffering compartment formed in the cylinder housing and communicating with the chamber of the cylinder housing for partially receiving the pressurized air or for receiving a portion of the pressurized air and for buffering purposes and for allowing the piston head to effectively compress or pump the air in the pumping movement or stroke and/or for suitably increasing the compressing or pumping or pressurizing effect or operation to the air.

In accordance with one aspect of the invention, there is provided an air compressor assembly comprising a cylinder housing including a chamber formed therein and defined by an inner peripheral surface, an outlet receptacle provided on the cylinder housing and including a bore formed therein, and including a partition provided between the cylinder housing and the outlet receptacle, and including an air passage formed in the partition and communicating with the chamber of the cylinder housing for receiving a pressurized air from the chamber of the cylinder housing, and communicating with the bore of the outlet receptacle, and including a valve seat formed between the cylinder housing and the outlet receptacle, a piston slidably received in the chamber of the cylinder housing, a motor coupled to the piston for moving the piston relative to the cylinder housing in a reciprocating action in order to generate a pressurized air and for allowing the pressurized air to be supplied from the chamber of the cylinder housing to the bore of the outlet receptacle, and a spring-biased check valve disposed in the outlet receptacle and engaged with the valve seat and the partition for selectively blocking the air passage of the partition and for guiding the pressurized air to flow from the chamber of the cylinder housing into the bore of the outlet receptacle, and to prevent the pressurized air from flowing backwardly from the bore of the outlet receptacle into the chamber of the cylinder housing, the partition includes a channel formed therein and communicating with the chamber of the cylinder housing, and the cylinder housing includes a casing having a compartment formed in the casing and communicating with the channel of the partition for partially receiving the pressurized air and for buffering purposes.

The cylinder housing includes an adjustable plug engaged in the compartment of the casing for adjusting a volume of the compartment of the casing. The adjustable plug includes an adjusting member threaded and engaged with the casing for adjusting the volume of the compartment of the casing.

The cylinder housing includes a spacing wall or panel provided between the casing and the outlet receptacle for spacing and separating the compartment of the casing and the bore of the outlet receptacle from each other. The outlet receptacle includes a duct communicating with the bore of the outlet receptacle for receiving the pressurized air from the bore of the outlet receptacle.

The cylinder housing includes a relief valve having a valve piece disposed and engaged in the duct for selectively blocking an air passage between the duct and the outlet receptacle, and a fastener threaded and engaged with the duct for selectively enclosing the duct and for retaining the valve piece in the duct, the fastener includes an orifice formed therein, and an actuating knob includes a shank slidably engaged in the orifice of the fastener and contactable and engageable with the valve piece for selectively depressing the valve piece to selectively relieve the pressurized air. The valve piece includes a cone shaped structure having at least one notch for forming and defining at least one blade and for air relieving or dissipating purposes.

The cylinder housing includes a cover detachably attached to the outlet receptacle, and the cover includes a stem extended therefrom for engaging into the outlet receptacle and for engaging with the spring-biased check valve and for retaining the spring-biased check valve within the outlet receptacle. The stem includes at least one peripheral recess formed in an outer peripheral portion for forming and defining at least one peripheral flange and for engaging with at least one sealing ring.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
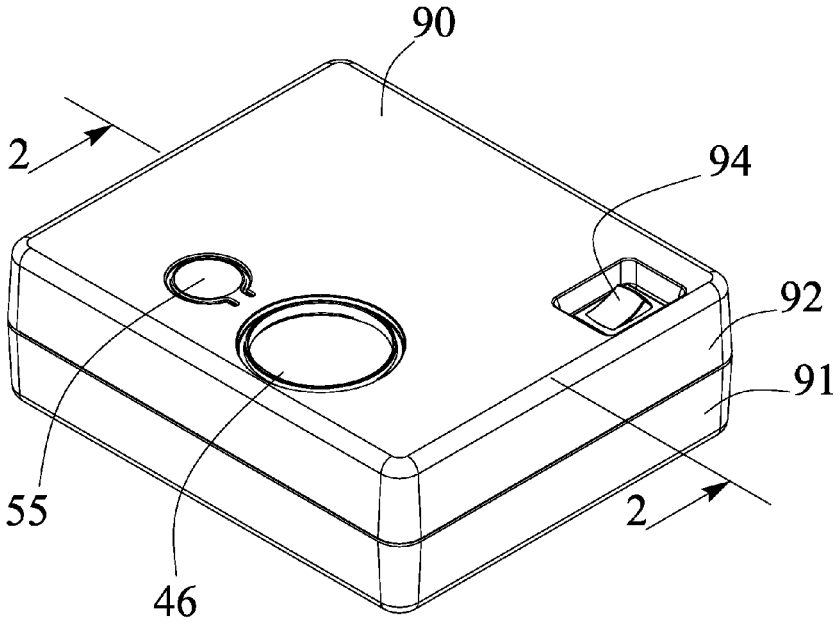
FIG. 1 is a perspective view of an air compressor assembly in accordance with the present invention.
Figure 2:
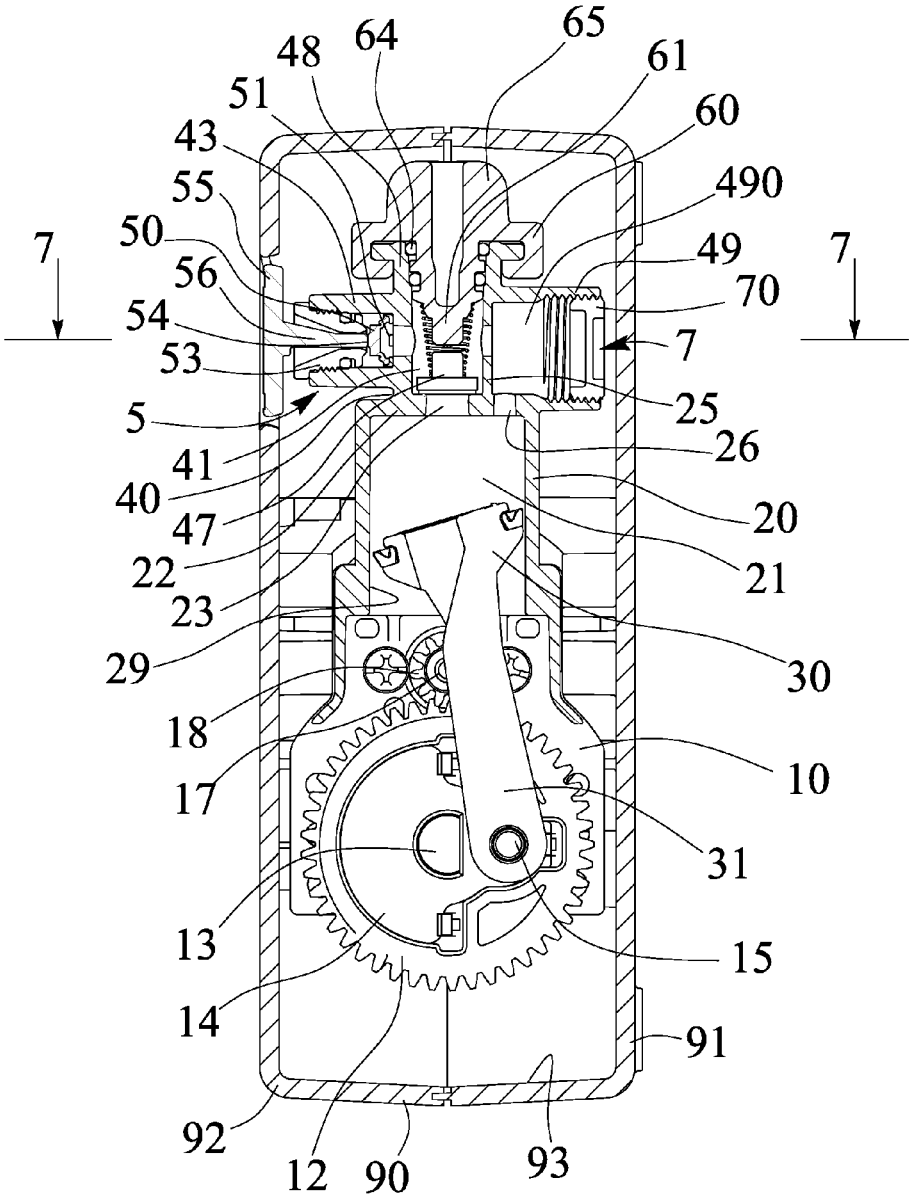
FIG. 2 is a cross sectional view of the air compressor assembly, taken along lines 2-2 of FIG. 1.
Figure 3:
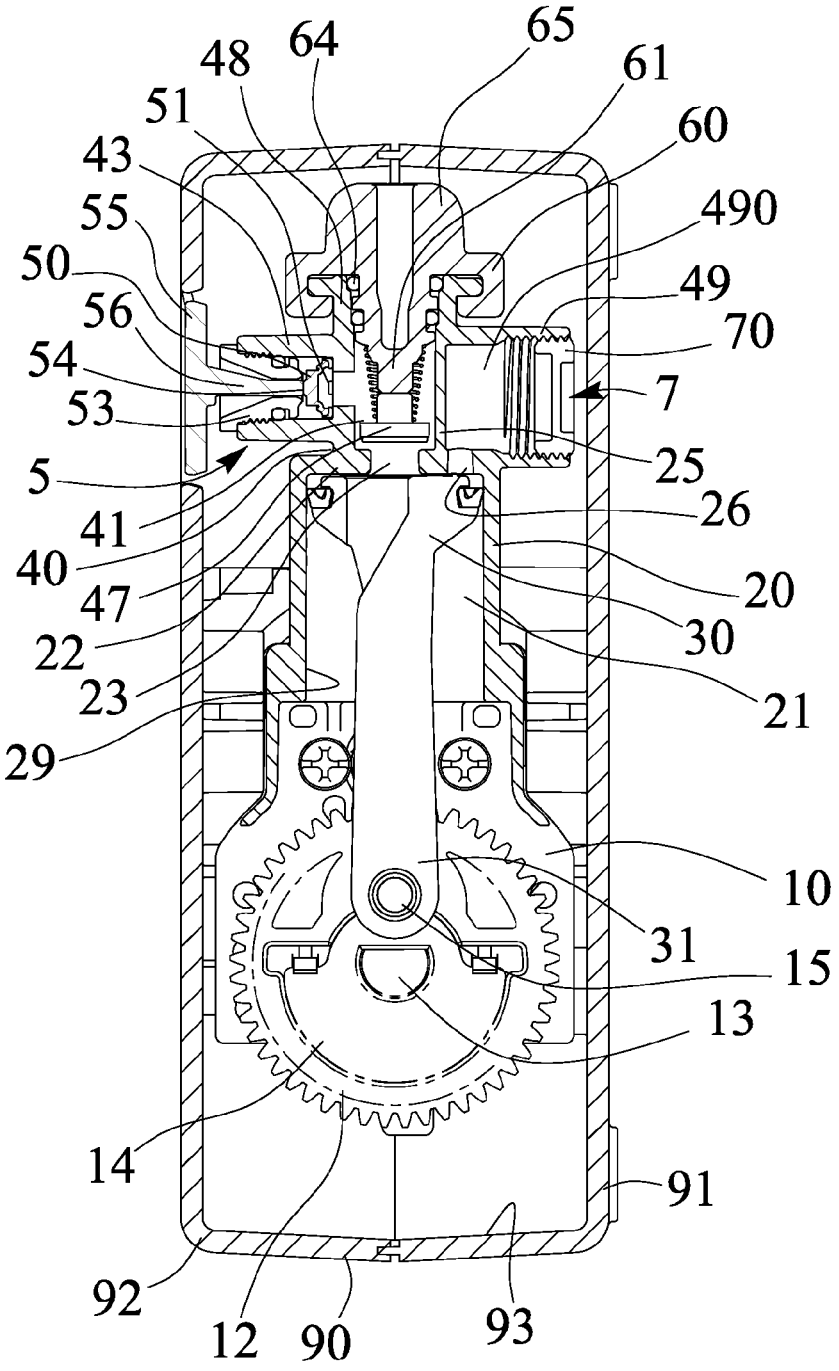
FIG. 3 is another cross sectional view similar to FIG. 2, illustrating the operation of the air compressor assembly.

Referring to the drawings, and initially to FIGS. 1-3, an air compressor assembly in accordance with the present invention comprises an outer receptacle or housing or container 90 including a supporting lower or bottom container member 91 and an upper covering member 92 openably attached or mounted or secured or coupled or anchored or retained or position together to form and to provide a chamber or compartment or space 93 in the container 90 for receiving or accommodating an air compressor device 1. As shown in FIGS. 2-5, the air compressor device 1 includes a supporting base 10 including a supporting plate 11 and a cylinder housing 20 provided on or extended from the supporting plate 11 and preferably, but not necessarily formed integral with the supporting plate 11.

Figure 4:
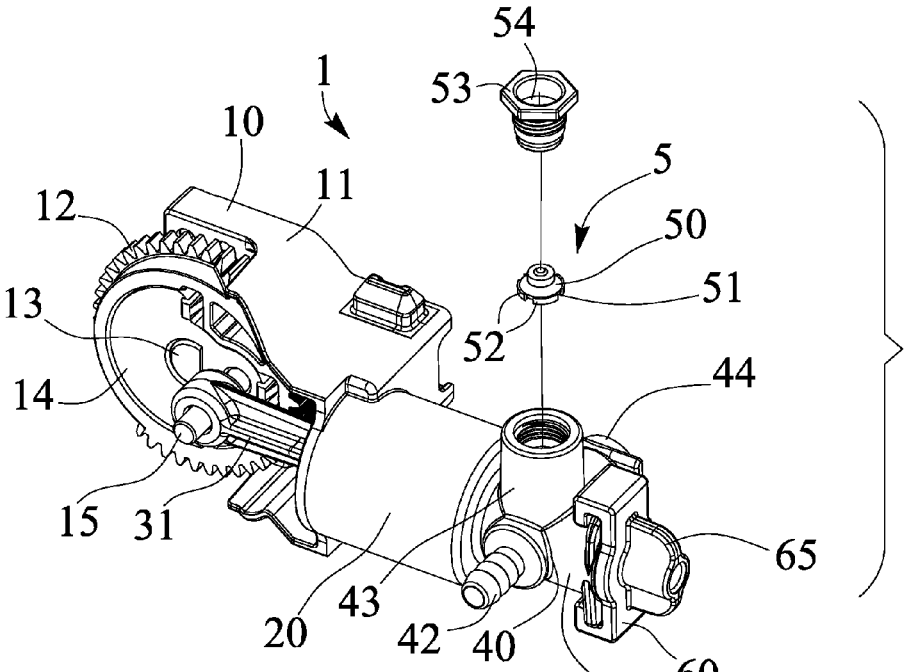
FIG. 4 is a partial exploded view illustrating some of the parts or elements of the air compressor assembly.
Figure 5:
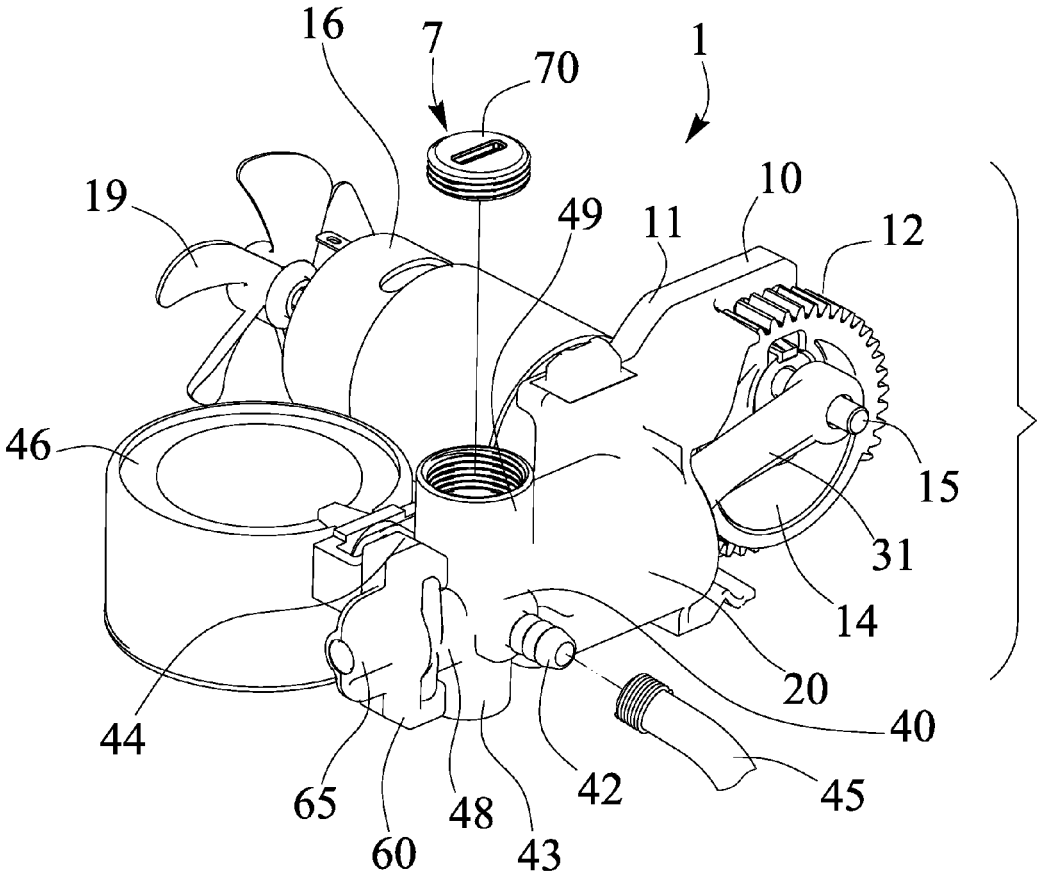
FIG. 5 is another partial exploded view of the air compressor assembly.

For example, the supporting plate 11 and the cylinder housing 20 may be formed integral with each other, as shown in FIGS. 4 and 5, with the molding or mold-injection processes, for example, or alternatively, the cylinder housing 20 may include one or more projections (not shown) extended therefrom and engaged with corresponding hubs or tubular members (not shown) of the supporting plate 11 for detachably attaching or mounting or securing the cylinder housing 20 to the supporting plate 11. The cylinder housing 20 includes a chamber 21 formed therein and formed or defined by an inner peripheral surface 29 for slidably receiving or engaging with a piston 30 which includes an extension or piston rod 31 extended from the piston 30 and slidable in a reciprocating action in the chamber 21 of the cylinder housing 20 for generating a pressurized air.

A gear 12 is rotatably attached to the lower portion of the supporting plate 11 with one or more bearings (not shown) and a shaft 13, and an eccentric member 14 is attached or secured to the gear 12 with such as fasteners (not shown) or with the molding or mold-injection processes and may thus be rotated in concert with the gear 12, and includes a crank or an eccentric pin 15 extended therefrom and coupled to a free end portion of the piston rod 31 of the piston 30 (FIGS. 2-5, 8) in order to actuate or to move the piston 30 relative to the cylinder housing 20 in reciprocating actions. A motor 16 (FIGS. 4-5) may be attached or secured to the upper portion of the supporting plate 11 with such as fasteners (not shown), and includes a spindle 17 (FIGS. 2, 8) extended through the supporting plate 11, and includes a pinion 18 secured to the spindle 17 thereof.

Figure 6:
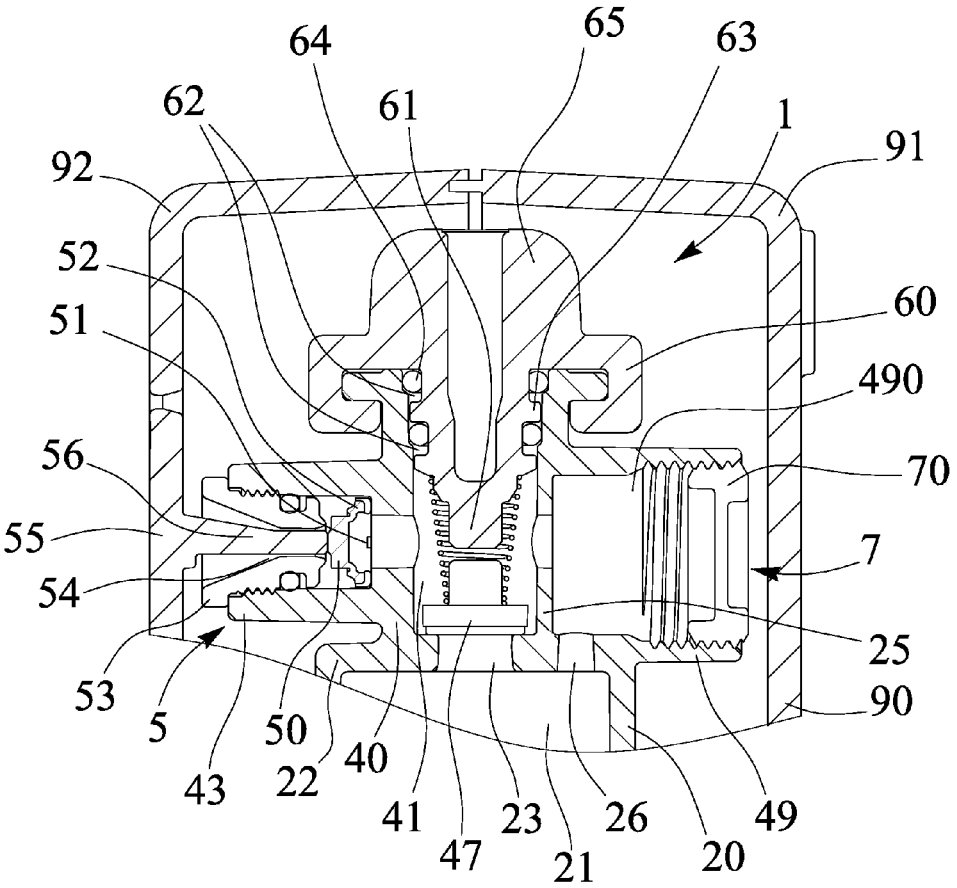
FIG. 6 is an enlarged partial cross sectional view of the air compressor assembly.
Figure 8:
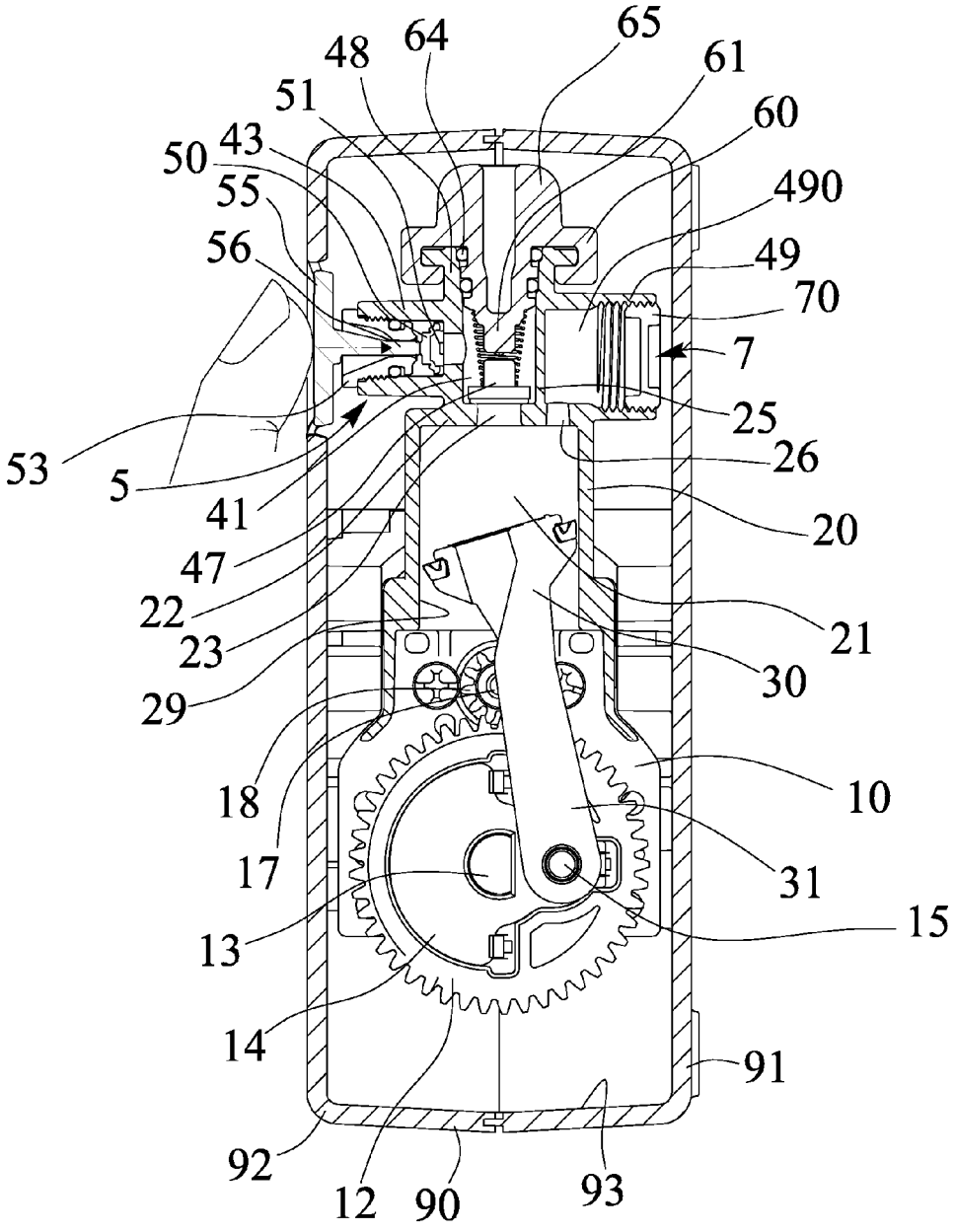
FIG. 8 is a further cross sectional view similar to FIGS. 2 and 3, illustrating the operation of the relief valve device for the air compressor assembly.

As also shown in FIGS. 2 and 8, the pinion 18 of the motor 16 is meshed or engaged with the gear 12 for allowing the gear 12 to be pivoted or rotated or driven by the motor 16 with the pinion 18, and thus for allowing the piston 30 to be actuated to move relative to the cylinder housing 20 in the reciprocating actions by the eccentric member 14 and the eccentric pin 15. A fan device 19 (FIGS. 4-5) may further be provided and coupled to the motor 16 for being rotated or driven by the motor 16 to generate a circulating or ventilating air. The cylinder housing 20 includes an outlet tube or barrel or receptacle 40 extended upwardly or outwardly from the top thereof, and having a compartment or bore 41 formed therein (FIGS. 2-3, 6) and communicating with the chamber 21 of the cylinder housing 20, for receiving the pressurized air from the chamber 21 of the cylinder housing 20.

For example, the cylinder housing 20 includes an upper panel or wall or partition 22 disposed or formed or provided between the cylinder housing 20 and the outlet receptacle 40 and includes an air pathway or conduit or passage 23 formed in the partition 22 for allowing the pressurized air to be supplied from the chamber 21 of the cylinder housing 20 to the bore 41 of the outlet receptacle 40, and includes a valve seat 24 formed or provided between the cylinder housing 20 and the outlet receptacle 40, such as formed or provided in the partition 22 and between the air passage 23 of the partition 22 and the bore 41 of the outlet receptacle 40. The outlet receptacle 40 further includes one or more ducts 42, 43, 44 (FIG. 7) extended outwardly therefrom and communicating with the bore 41 of the outlet receptacle 40, for receiving the pressurized air from the bore 41 of the outlet receptacle 40.

The ducts 42, 43, 44 may be coupled to various kinds of facilities that require pressurized air supplied thereto. For example, a nozzle (not shown) may be provided and attached to one of the ducts 42 with a hose 45 (FIGS. 5, 7) for allowing the pressurized air to be supplied from the chamber 21 of the cylinder housing 20 and the bore 41 of the outlet receptacle 40 to various pneumatic facilities that require pressurized air supplied thereto, with the nozzle. The hose 45 may be received or engaged or contained or retained in the space 93 of the container 90. The container 90 includes a switch 94 formed or provided therein (FIG. 1) for actuating or operating the air compressor device 1. A pressure gauge 46 may further be provided and attached to the other duct 44 (FIGS. 5, 7) for detecting and showing the air pressure within the cylinder housing 20 and/or the outlet receptacle 40, and may be provided and exposed outwardly through the container 90 (FIG. 1) for being viewed and read by the users.

A spring-biased check valve 47 (FIGS. 2-3, 6, 8) is disposed in the other duct 48 of the outlet receptacle 40 or directly in the outlet receptacle 40, or on top of the partition 22 of the cylinder housing 20, and engaged with the partition 22 or the valve seat 24 that is formed or provided between the outlet receptacle 40 and the cylinder housing 20 for selectively blocking or enclosing or sealing the air passage 23 of the partition 22, and the spring-biased check valve 47 may be used to limit and to guide the pressurized air to flow only from the chamber 21 of the cylinder housing 20 into the bore 41 of the outlet receptacle 40, and to prevent the pressurized air from flowing backwardly from the bore 41 of the outlet receptacle 40 into the chamber 21 of the cylinder housing 20. The above-described structure or configuration for the air compressor assembly is typical and is not related to the present invention and will not be described in further details.

The air compressor device 1 includes a lid or cap or cover 60 for openably or detachably attaching or mounting or securing to the other duct 48 of the outlet receptacle 40, and the cover 60 includes a rod or extension or shank or stem 61 extended therefrom for engaging with or into the other duct 48 of the outlet receptacle 40 and for selectively contacting or engaging with the spring-biased check valve 47 and for solidly and stably anchoring or retaining or positioning the spring-biased check valve 47 within the other duct 48 of the outlet receptacle 40, and the stem 61 includes one or more (such as two) peripheral recesses 62 formed in the outer peripheral portion thereof (FIG. 6) for forming or defining one or more (such as two) peripheral ribs or flanges 63 and for receiving or engaging with gaskets or sealing rings 64, and the cover 60 includes a knob or button or handle or actuating member or hand grip 65 for rotating or driving the cover 60 relative to the other duct 48 of the outlet receptacle 40.

A safety valve or relief valve 5 (FIGS. 2-8) may be provided and attached to another duct 43 for relieving the pressurized air when the air pressure within the cylinder housing 20 and/or the outlet receptacle 40 is over a predetermined pressure, and thus for preventing the cylinder housing 20 and/or the outlet receptacle 40 from being over-pressurized and damaged. For example, the relief valve 5 includes a soft or spring or resilient valve piece 50 disposed or engaged in the duct 43 for selectively blocking or enclosing or sealing or controlling the air passage between the duct 43 and the outlet receptacle 40. The valve piece 50 includes a substantially semi-spherical or dome or cone shaped structure or configuration having one or more voids or notches 51 formed therein for forming or defining one or more blades 52 and for air relieving or dissipating purposes.

The relief valve 5 further includes a screw or bolt or fastener 53 threaded or engaged with the duct 43 for selectively enclosing or sealing or locking the duct 43 and for solidly and stably anchoring or retaining or positioning the valve piece 50 in the duct 43 and for preventing the valve piece 50 from being disengaged or separated from the duct 43 inadvertently. The fastener 53 includes an aperture or bore or pathway or orifice 54 formed therein for slidably receiving or engaging with a stem or rod or extension or shank 56 of an actuating member or button or knob 55, in which the shank 56 of the actuating knob 55 is contactable or engageable with the valve piece 50 for selectively compressing or depressing or operating or actuating or forcing the valve piece 50 (FIG. 8) to selectively relieve the pressurized air when the air pressure within the cylinder housing 20 and the outlet receptacle 40 is over a predetermined value, by compressing or operating or actuating or depressing the actuating knob 55.

It is to be noted that the provision or the extension of the ducts 42, 43, 44, 48 from the outlet receptacle 40 allows the relief valve 5 and the pressure gauge 46 and the nozzle to be easily and readily attached to or coupled to the outlet receptacle 40 with the ducts 42, 43, 44, 48 without additional or specialized coupling members or tools. One or more covers or caps lids (not shown) may further be provided and attached or secured to either of the ducts 42, 43, 44, 48 with such as a threading engagement, for selectively enclosing or blocking the ducts 42, 43, 44, 48 when the ducts 42, 43, 44, 48 are not required to be used, or when the relief valve 5 and the pressure gauge 46 and the nozzle are not attached or secured to the ducts 42, 43, 44, 48.

In operation, as shown in FIGS. 2 and 3, the piston 30 may be actuated or moved relative to the cylinder housing 20 in the reciprocating actions by the motor 16 with the pinion 18, the gear 12, the eccentric member 14 and the eccentric pin 15, in order to generate a pressurized air, and to allow the pressurized air to flow into the outlet receptacle 40, and then to flow out through either or all of the ducts 42, 43, 44, 48, and thus to allow the air pressure within the cylinder housing 20 and/or the outlet receptacle 40 to be detected and shown by the pressure gauge 46, and to allow the pressurized air to be supplied into the facilities that require pressurized air supplied thereto, with the nozzle, and/or to allow the pressurized air to be relieved via the relief valve 5 when the cylinder housing 20 and/or the outlet receptacle 40 is over-pressurized.

Referring again to FIGS. 2-8, the outlet receptacle 40 and/or the cylinder housing 20 includes a further duct or casing 49 extended outwardly therefrom, such as extended outwardly from the outlet receptacle 40 or from the cylinder housing 20 and having a chamber or space or cavity or compartment 490 formed therein (FIGS. 6-8) for receiving or engaging with another relief valve or safety valve or regulating valve or adjustable plug 7, and the compartment 490 of the casing 49 is offset or spaced or separated from the bore 41 of the outlet receptacle 40 with a separating wall or panel 25; i.e., the outlet receptacle 40 and/or the cylinder housing 20 includes a separating wall or panel 25 for spacing or separating the compartment 490 of the casing 49 and the bore 41 of the outlet receptacle 40 from each other and for preventing the pressurized air from flowing from the bore 41 of the outlet receptacle 40 into the compartment 490 of the casing 49.

The cylinder housing 20 further includes a channel 26 formed therein, such as formed in the partition 22 and communicating with the chamber 21 of the cylinder housing 20 and also communicating with the compartment 490 of the casing 49 for allowing the compartment 490 of the casing 49 to partially receive the pressurized air and/or to receive a portion of the pressurized air for buffering purposes when the piston 30 is moved toward the partition 22, and for allowing the piston 30 to effectively compress or pump the air in the pumping movement or stroke and/or for suitably increasing the compressing or pumping or pressurizing effect or operation to the air. The adjustable plug 7 includes a screw or bolt or fastener or adjusting member 70 threaded or engaged with the casing 49 for adjusting the space or size or dimension or volume of the compartment 490 of the casing 49.

Figure 7:
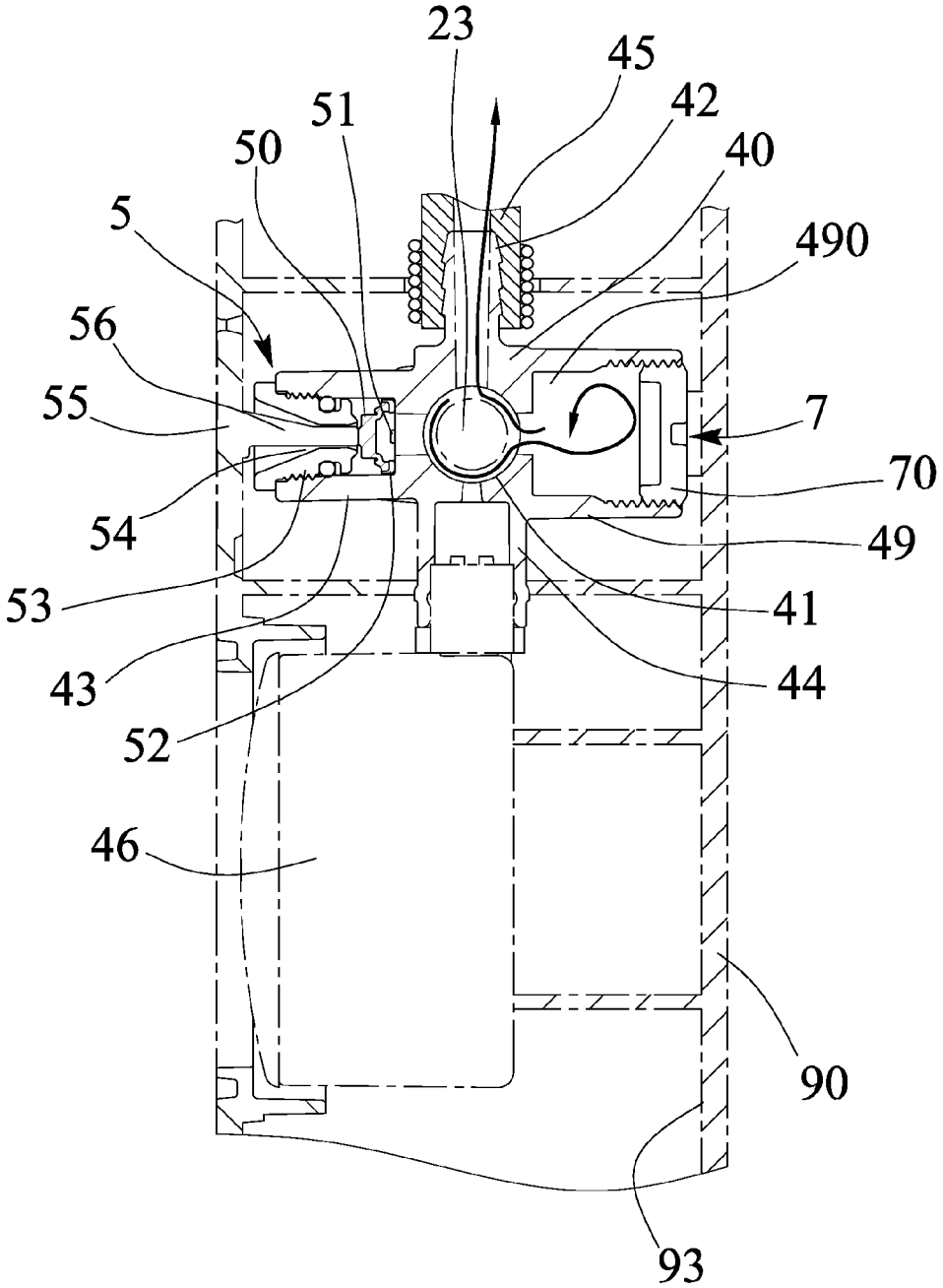
FIG. 7 is another partial cross sectional view of the air compressor assembly, taken along lines 7-7 of FIG. 6.

In operation, as shown in FIGS. 7-8, when the adjusting member 70 is threaded or pivoted or rotated relative to the casing 49, the adjusting member 70 may be adjusted or moved relative to the casing 49 for adjusting the space or size or dimension or volume of the compartment 490 of the casing 49 that may be used to partially receive the pressurized air and/or to receive a portion of the pressurized air for buffering purposes when the piston 30 is moved toward the partition 22. The adjusting member 70 may be adjusted or moved relative to the casing 49 for adjusting the space or size or dimension or volume of the compartment 490 of the casing 49 that is communicating with the chamber 21 of the cylinder housing 20 and thus for adjusting the space or size or dimension or volume to partially receive the pressurized air and/or to receive a portion of the pressurized air for buffering purposes when the piston 30 is moved toward the partition 22.

In operation, as shown in FIGS. 2-3 and 6-8, when the piston 30 is actuated to move relative to the cylinder housing 20 in the reciprocating actions in order to generate the pressurized air, and particularly when the piston 30 is moved toward the partition 22, the compartment 490 of the casing 49 that is communicating with the chamber 21 of the cylinder housing 20 may be used to partially receive the pressurized air and/or to receive a portion of the pressurized air for buffering purposes, and for slightly reducing or adjusting the pressure of the pressurized air and for preventing the pressurized air supplied out through the nozzle and to the air facilities from being over-pressurized.

Accordingly, the air compressor assembly in accordance with the present invention includes a cylinder housing having a compressing chamber for slidably receiving or engaging with a piston and having a buffering compartment formed in the cylinder housing and communicating with the compressing chamber of the cylinder housing for partially receiving the pressurized air or for receiving a portion of the pressurized air and for buffering purposes and for allowing the piston head to effectively compress or pump the air in the pumping movement or stroke and/or for suitably increasing the compressing or pumping or pressurizing effect or operation to the air.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor assembly comprising:

a cylinder housing including a chamber formed therein and defined by an inner peripheral surface, an outlet receptacle provided on said cylinder housing and including a bore formed therein, and including a partition provided between said cylinder housing and said outlet receptacle, and including an air passage formed in said partition and communicating with said chamber of said cylinder housing for receiving a pressurized air from said chamber of said cylinder housing, and communicating with said bore of said outlet receptacle, and including a valve seat formed between said cylinder housing and said outlet receptacle, a piston slidably received in said chamber of said cylinder housing, a motor coupled to said piston for moving said piston relative to said cylinder housing in a reciprocating action in order to generate a pressurized air and for allowing the pressurized air to be supplied from said chamber of said cylinder housing to said bore of said outlet receptacle, and a spring-biased check valve disposed in said outlet receptacle and engaged with said valve seat and said partition for selectively blocking said air passage of said partition and for guiding the pressurized air to flow from said chamber of said cylinder housing into said bore of said outlet receptacle, and to prevent the pressurized air from flowing backwardly from said bore of said outlet receptacle into said chamber of said cylinder housing, wherein:

said outlet receptacle includes a duct communicating with said bore of said outlet receptacle for receiving the pressurized air from said bore of said outlet receptacle, said partition includes a channel formed therein and communicating with said chamber of said cylinder housing, and said cylinder housing includes a casing having a compartment formed in said casing and communicating with said channel of said partition for partially receiving the pressurized air, and said cylinder housing includes an adjustable plug engaged in said compartment of said casing for adjusting a volume of said compartment of said casing.

2. The air compressor assembly as claimed in claim 1, wherein said adjustable plug includes an adjusting member threaded and engaged with said casing for adjusting said volume of said compartment of said casing.

3. The air compressor assembly as claimed in claim 1, wherein said cylinder housing includes a separating panel provided between said casing and said outlet receptacle for spacing and separating said compartment of said casing and said bore of said outlet receptacle from each other.

4. The air compressor assembly as claimed in claim 1, wherein said cylinder housing includes a relief valve having a valve piece disposed and engaged in said duct for selectively blocking an air passage between said duct and said outlet receptacle, and a fastener threaded and engaged with said duct for selectively enclosing said duct and for retaining said valve piece in said duct, said fastener includes an orifice formed therein, and an actuating knob includes a shank slidably engaged in said orifice of said fastener and contactable and engageable with said valve piece for selectively depressing said valve piece to selectively relieve the pressurized air.

5. The air compressor assembly as claimed in claim 1, wherein said cylinder housing includes a cover detachably attached to said outlet receptacle, and said cover includes a stem extended therefrom for engaging into said outlet receptacle and for engaging with said spring-biased check valve and for retaining said spring-biased check valve within said outlet receptacle.

6. The air compressor assembly as claimed in claim 5, wherein said stem includes at least one peripheral recess formed in an outer peripheral portion for forming and defining at least one peripheral flange and for engaging with at least one sealing ring.

* * * * *